United States Patent [19]

Townsend et al.

[11] Patent Number: 4,911,356

[45] Date of Patent: Mar. 27, 1990

[54] PACKAGE

[76] Inventors: Colin J. B. Townsend, 62 Owens Road, Epsom, Auckland; Richard J. Anderson, C/-Printpac Case Group, Taurarua; Raymond J. Pryor; James F. Pharoah, both of C/- AHI Plastic Moulding Company, 396 Te Rapa Road, Te Rapa; Bruce W. Oswin, C/-Printpac Case Group, 3 Olive Road, Auckland, all of Netherlands

[21] Appl. No.: 188,983

[22] Filed: May 2, 1988

[30] Foreign Application Priority Data

May 1, 1987 [NZ] New Zealand ..... 220172

[51] Int. Cl.[4] ..... B65D 5/32

[52] U.S. Cl. ..... 229/166; 229/23 R; 229/143; 229/178; 229/919; 229/DIG. 11

[58] Field of Search ..... 229/23 R, 143, 148, 229/151, 166, 178, 918, 919, DIG. 11; 206/509, 512

[56] References Cited

U.S. PATENT DOCUMENTS

| | | | |
|---|---|---|---|
| 3,373,921 | 3/1968 | Crane | 229/23 R |
| 3,448,914 | 6/1969 | Scholz | 206/509 |
| 3,905,541 | 9/1975 | Paxton | 206/509 |
| 4,053,098 | 10/1977 | Baptist | 229/23 R |
| 4,068,794 | 1/1978 | Lawrence | 229/23 R |
| 4,134,533 | 1/1979 | Heauner | 229/DIG. 11 |
| 4,151,948 | 5/1979 | de la Fuente, Jr. | 229/DIG. 11 |
| 4,175,691 | 11/1979 | Cornell et al. | 229/23 R |
| 4,645,122 | 2/1987 | Nederveld | 229/23 R |

FOREIGN PATENT DOCUMENTS

| | | | |
|---|---|---|---|
| 30713 | 9/1978 | Chile . | |
| 7139363 | 6/1973 | France . | |
| 2240156 | 3/1975 | France | 229/DIG. 11 |
| 2449605 | 9/1980 | France | 229/919 |
| 1421221 | 1/1976 | United Kingdom | 229/DIG. 11 |
| 2011357 | 7/1979 | United Kingdom . | |

*Primary Examiner*—Gary Elkins

*Attorney, Agent, or Firm*—Fleit, Jacobson, Cohn, Price, Holman & Stern

[57] ABSTRACT

A package in the form of a tray, carton or case has at least a base, side walls and end walls, a support formed by two panels positioned within the package, one adjacent each of end walls, or side walls, protrusions, and/or recesses on each panel of a size so that with the packages positioned in a stack, vertically adjacent protrusions and/or recesses are in contact without substantial compression of the packaging material positioned between vertically adjacent panels, and positioned apertures in the package to receive protrusions. The package in a preferred form also includes lugs provided at each corner of one face, the lugs being angled and the package also having corresponding cut-outs so that in a vertical stack the lugs of one package are positioned in the cut-outs of a vertically adjacent package.

20 Claims, 5 Drawing Sheets

PACKAGE

BACKGROUND OF THE INVENTION

This invention relates to a package.

Packages and packages formed from cardboard such as corrugated cardboard and formed from material having like properties and used for transportation of fruit, for example, are known which stack one upon another and which may be interconnected for example by interlocking tongues and apertures. Such packages can be disadvantageous in that applying strapping or other pressures to the package may cause the material from which the wrapper of the package is made to compress. For example, a stack of such packages may compress about 1 mm to 1½ mm for each thickness of board. Thus in a 30 high stack compression of up to 90 mm can occur. Such compression can cause difficulties, for example, size regularity may be lost, pressure can be exerted on the contents in some circumstances and there can be strength losses in the package as well as air gap loss.

BRIEF SUMMARY OF THE INVENTION

It is therefore an object of the present invention to provide a package which will obviate or minimize the foregoing disadvantages in a simple yet effective manner.

Accordingly, the invention consists in a package comprising a tray, carton, or case having a base, side walls, end walls, and a support comprising a pair of panels within the tray and positioned adjacent the pair of end walls and/or the pair of side walls, protrusions and/or recesses on each panel, the protrusions and/or recesses being sized so that with said package positioned in a stack of like packages, panels of adjacent packages in the stack have adjacent protrusions and/or recesses in contact without substantial compression of package material positioned between the panels, the packages being provided with suitable apertures to enable such contact to occur.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein.

DETAILED DESCRIPTION

Figure 1:
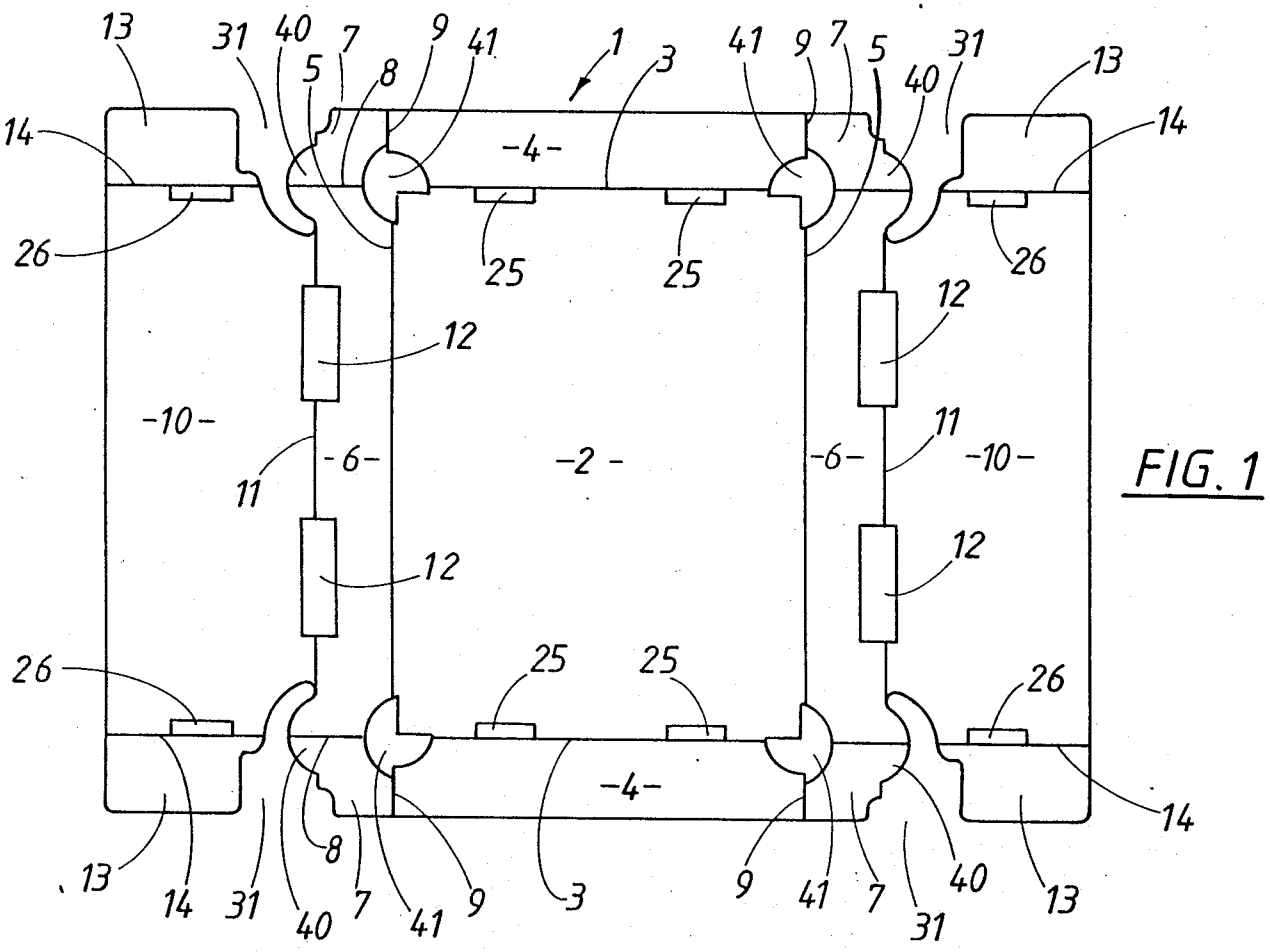
FIG. 1 is a top plan view of a blank for use in forming one preferred form of package according to the invention.

Referring to the drawings a package follows in accordance with the invention will now be described.

In one preferred form of the invention a package is formed utilizing a blank 1 as shown in FIG. 1 and formed for example of corrugated cardboard, or material having like properties. The blank has a base area 2 and from the base 2 through fold lines 3 are provided end walls 4 and through fold lines 5 are provided side walls 6. A locking tab 7 is provided at each end of the side wall 6 being separated from the side wall 6 through a fold line 8. The locking tab 7 in use is positioned against the end wall 4 and to this end a cut 9 is provided between those positions. The package could be a tray, a case, or a carton, but in the construction shown in FIG. 1 a case is provided which has a lid, for example a double lid, formed by a pair of lid flaps 10 separated from the side wall 6 through a fold line 11. Cut-outs 12 may be provided along the fold line 11 and these provide ventilation holes for the package when erected.

At the ends of the lid parts 10 is provided a lid locking tab 13 separated from the lid through fold lines 14 and the use of these will be further described hereinafter.

Figure 3:
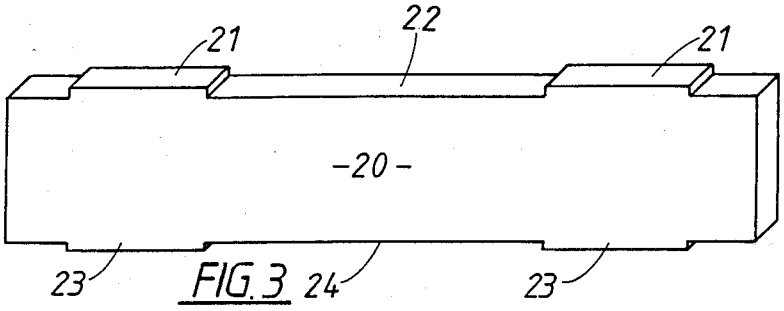

A support for the package is provided and this comprises a pair of panels which are to be positioned in the erected case adjacent the end walls 4. The package of one preferred form of the invention utilizes panels 20 as shown in FIG. 3. Each panel 20 may be formed from timber for example or other materials such as moulded plastics and provides a pair of extensions 21 on its upper surface 22. The panel 20 also provides extensions 23 on its lower surface 24. The panel 20 is positioned on the base 2 so than the downward protrusions 23 extend through apertures 25 formed in the lower surface 2. These are desirably a snug fit. The end wall 4 can be adhered to the panels 20 if desired. The protrusions 23 extend desirably substantially fully through the apertures 25.

It will be apparent that the position of the lids and apertures 25 can be rearranged so that the supports are provided on the longer or side walls.

In order to enclose the upper protrusions 21 suitable cut-outs 26 are provided on the lid parts.

Figure 4:
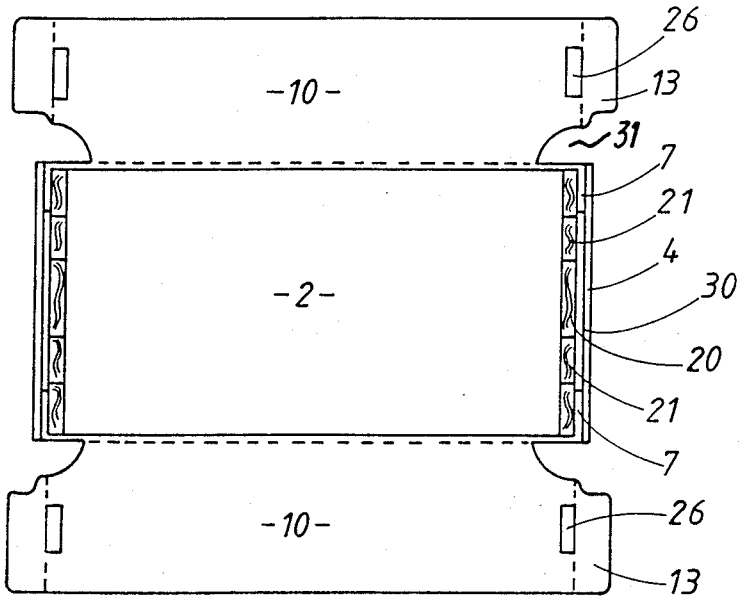
FIG. 4 is a top plan view of the blank of FIG. 1 and the end panel of FIG. 3, the blank being partially erected into a box.

If a panel 20 is positioned with its protrusions 23 extending through the apertures 25, the sides 6 are then folded up and the panels 7 turned inwardly. Finally the end panels 4 can be turned up so that a construction is provided substantially as shown in FIG. 4 in which a gap 30 is provided between the panel 20 and the end wall 4. If the lid panels 10 are then turned over the apertures 26 will pass over the protrusions 21 and the flaps or tabs 13 can be positioned into the slot 30 thereby retaining the lid flaps in a closed position. As can be seen from FIGS. 1 and 4 the blank has a suitably shaped cut-out at 31 to allow the correct positioning of the tabs 13. The tabs 7 can be adhered to the end wall 4 and if desired the panel 20 can also be adhered to the end wall 4.

The thickness of the panel 20 will depend on several factors including the expected weight of the package contents, the size of the package and the material from which the panel 20 is made.

Figure 6:
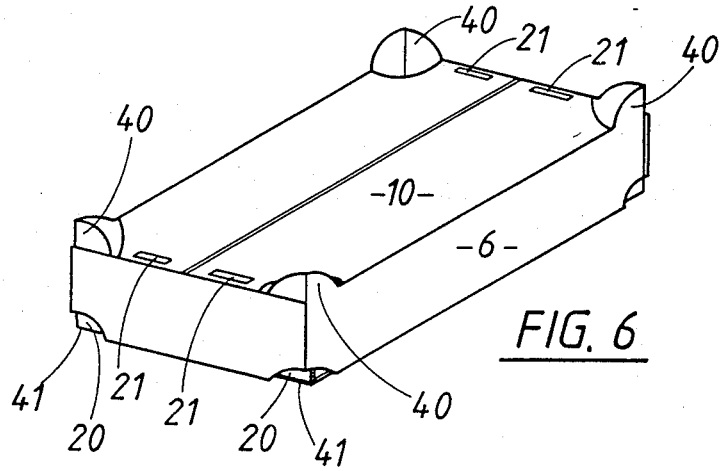
FIG. 6 is diagrammatic perspective view of a package according to a preferred form of the invention in an erected position.
Figure 7:
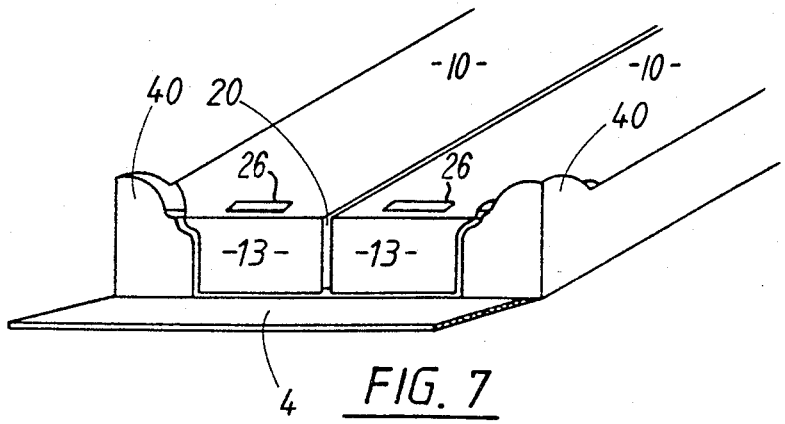
FIG. 7 is a diagrammatic perspective end view of the package of FIG. 6 with the end wall shown in an open position.

A locating means is also provided between adjacent packages in a stack thereof. These locating means may take the form of upstanding angled tabs 40 provided at each corner particularly of the upper surface of the package for example as shown in FIGS. 6 and 7. The tabs 40 can also be seen in FIG. 1 where they are formed in part by the shaping of the recess or cut-out 31. A cut-out 41 is also provided at the lower corners of the package and this can be formed by the removed portion 41 shown in FIG. 1. It is important to also remove a part of the corner tab 7. The shaping of the tab 40 and cut-out 41 is desirable also so that the snug fit is achieved and in the embodiment shown this is achieved by making the cut-outs arcuate at least in the positions where the edge of the tab 40 will be adjacent the edge of the cut-out 41.

Because the protrusions 21 and 23 are substantially of a length such that they will pass wholly through the apertures 25 and 26 when a stack of packages is provided and with tabs 40 positioned into recesses or cut-outs 41 the adjacent protrusions 21 and 23 will come into contact without substantial crushing of the material from which the package is made.

Figure 2:
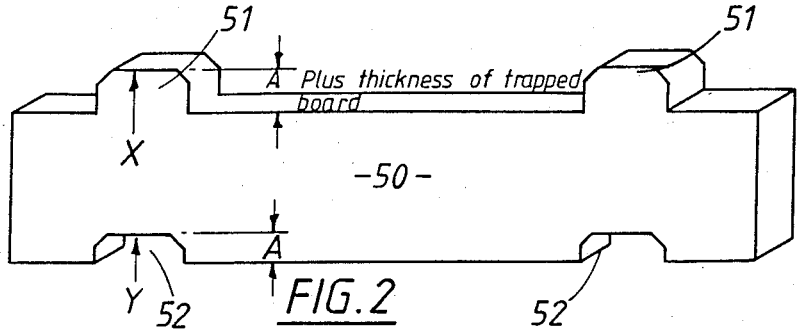
FIG. 2 and FIG. 3 are diagrammatic perspective views of two alternative end panels for use in the construction of the invention.

Referring now to FIG. 2 an alternative panel 50 is provided which has protrusions 51 on its upper surface and recesses 52 on its lower edge or surface. The protrusions 51 are made a little longer, for example a height X, than the depth of the recesses which are for example of a depth Y. If the external measurement of the depth is called A then the external measurements of the protrusion X is A plus the thickness of board or material which will be trapped inbetween panels in a stack. Again therefore panel to panel contact in the stack is achieved. In this construction the corner tabs 40 and 41 are not necessarily required as the protrusions 51 when entering the recesses 52 will give positioning of the adjacent stacks.

Figure 9:
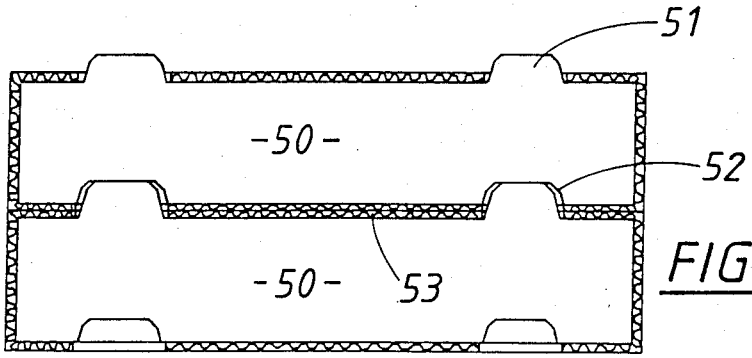
FIG. 9 is a view similar to FIG. 8, but with panels of the form shown in FIG. 2.

The use of such a construction is shown in FIG. 9 where a double thickness of packaging material can be seen at 53 between the two panels 50.

Figure 5:
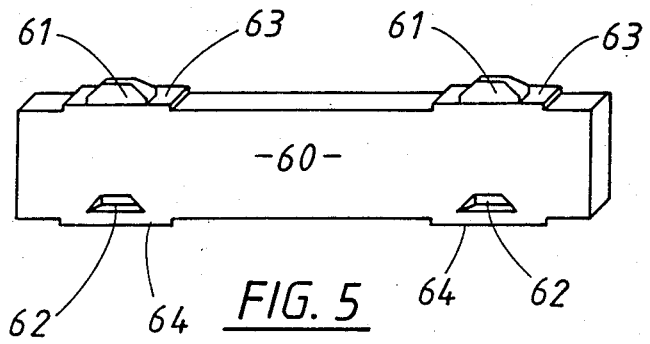
FIG. 5 is a perspective diagrammatic view of a further, alternative end panel.
Figure 8:
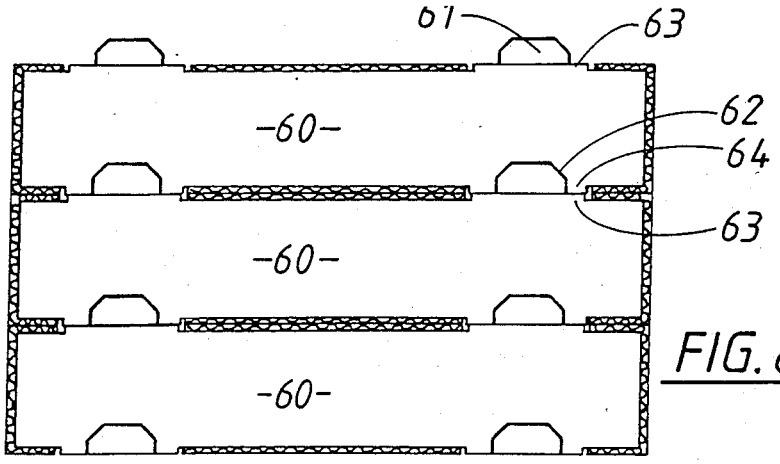
FIG. 8 is a diagrammatic cross-sectional view through a stack of packages the packages being shown without corner lugs and with end panels such as for example shown in FIG. 5.

An alternative end panel 60 is shown in FIG. 5 and in this construction protrusions 61 and recesses 62 are shown but these are provided on a base or plinth 63 and 64 respectively. The use of this type of construction is shown in FIG. 8 where it can be seen that contact between adjacent panels 60 is achieved by contact between the bases or plinths 64 and 63 while positioning is again achieved by the protrusion 61 being positioned into the recess 62.

Figure 10:
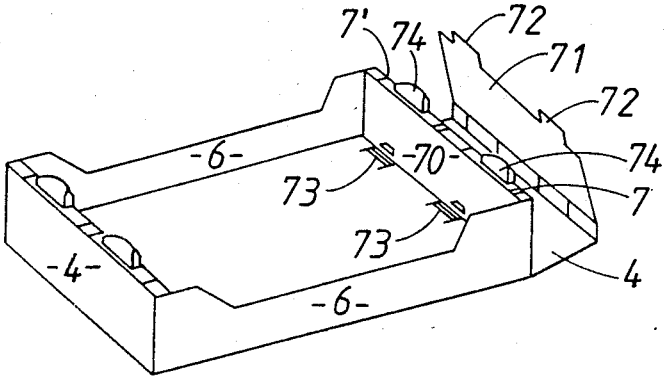
FIGS. 10 and 11 are diagrammatic perspective views of two alternative constructions of the invention.
Figure 11:
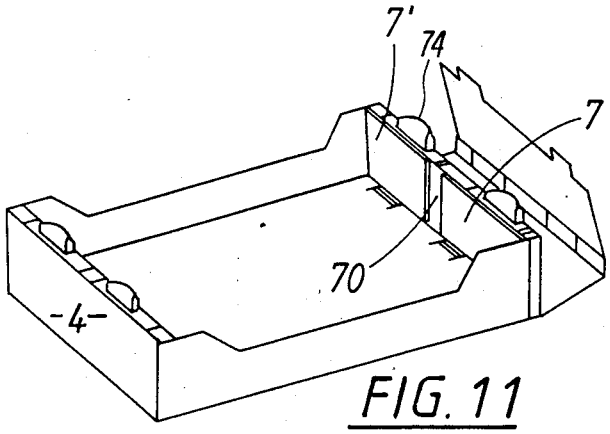
Figure 12:
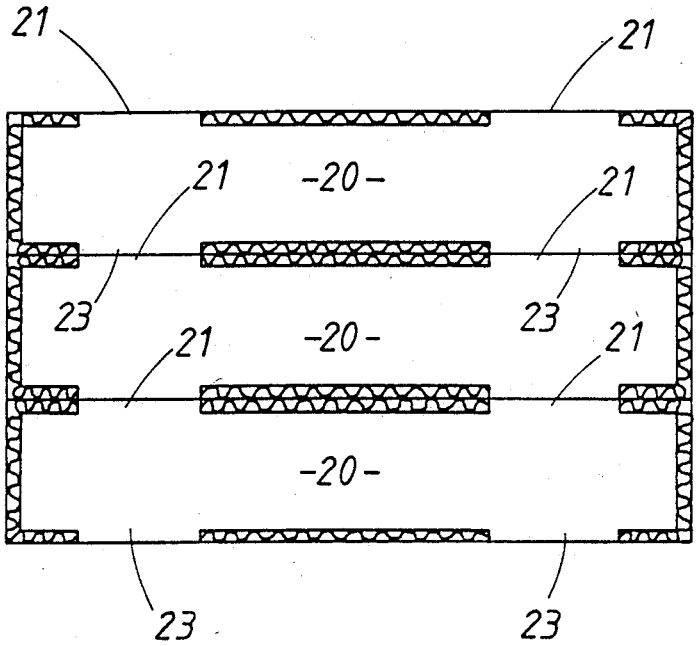
FIG. 12 is a view similar to FIG. 8 showing the use of the panel of FIG. 3.

In the embodiment of FIG. 10 the blank has been modified so as to provide a fold over end for the end panel 70, the tabs 71 being shown inwardly positioned in FIG. 11 and outwardly positioned in FIG. 10. In this embodiment the end wall 4 is extended by panel 71 which may be provided with tabs 72 at its extreme end able to fit into the apertures 73 which also receive in the stack the protrusions 74.

In use the packages of the invention are filled, for example with fruit and stacked. Engagement of the vertically adjacent panels reduces or eliminates any tendency of the material between the panels to crush either by weight of the packages or by application of strapping or the like.

Thus it can be seen that at least in a preferred form of the invention a package is provided which has the advantage that in a stack of like packages the end panels of the packages are in direct contact. Thus when the package or stack of packages is strapped and tightened pressure goes onto the in contact panels and there is no, or substantially no, compression of the material from which the wrapper of the package is made. This has the advantage that there is little or no tendency for the stack of packages to loosen during transportation or storage particularly when a substantial number of packages are contained in the stack. This invention obviates or minimizes the difficulties attendant on compression of material in the stack. Also at least the preferred form of the invention provides a strong corner and end construction for the protection of the product contained in the package.

What is claimed is:

1. A package made of package material in the form of a tray, carton or case comprising:

a base having opposite sides and opposite ends;

side walls extending from said sides;

end walls extending from said ends;

apertures in said package adjacent said end walls;

a pair of support panels disposed within the package adjacent said end walls; and protrusions on said support panels extending through at least some of said apertures and having predetermined dimensions with respect to the thickness of the package material so that when said package is substantially vertically stacked with a plurality of said packages, with said protrusions extending through said apertures, said protrusions of one package engage corresponding adjacent support panels of adjacent packages in the stack to thereby prevent substantial compression of package material disposed between said engaged adjacent support panels.

2. A package as claimed in claim 1 wherein:

said apertures comprise lower apertures in said base;

each support panel has an upper edge; and said protrusions comprise upper protrusions extending from said upper edges.

3. A package as claimed in claim 2 wherein:

each support panel has a lower edge;

said protrusions further comprise lower protrusions extending from said lower edges; and said lower apertures are aligned with and receive therein said lower protrusions so that when a plurality of said packages are stacked said upper protrusions of one support panel engage with said lower protrusions of the adjacent corresponding support panel.

4. A package as claimed in claim 2 wherein:

said predetermined dimensions comprise at least said upper protrusions extending from said upper edge a distance substantially equal to the thickness of the package material.

5. A package as claimed in claim 4 wherein:

said support panels comprise wood material.

6. A package as claimed in claim 4 wherein:

said support panels comprise molded plastics material.

7. A package as claimed in claim 3 wherein:

each end wall has a flap portion extending over at least said upper edge of the adjacent support panel;

said apertures further comprise upper apertures in said flap portions aligned with and receiving said upper protrusions; and said predetermined dimensions comprise said protrusions extending from said edges a distance substantially equal to the thickness of the package material.

8. A package as claimed in claim 7 wherein:

said support panels comprise wood material.

9. A package as claimed in claim 2 wherein:

said package is provided with a lid means;

said apertures further comprise upper apertures in said lid means; and said upper protrusions extend through said upper apertures.

10. A package as claimed in claim 2 wherein:

each support panel has a lower edge; and recesses are provided in said lower edge substantially aligned with said lower apertures so that when a plurality of said packages are substantially vertically stacked said upper protrusions of each package extend through said lower apertures and engage with the adjacent support panel of the adjacent package in said recesses.

11. A package as claimed in claim 10 wherein:

said predetermined dimensions comprise said upper protrusions extending from said upper edge of said support panel a distance substantially equal to the depth of said recesses from said lower edge of said support panel plus the thickness of the package material disposed between said adjacent engaged support panels.

12. A package as claimed in claim 11 wherein:

said package is provided with a lid means;

said apertures further comprise upper apertures in said lid means; and said upper protrusions extend through said upper apertures.

13. A package as claimed in claim 10 wherein: each end wall has a flap portion extending over at least said upper edge of the adjacent support panel; and said apertures further comprise upper apertures in said flap portions aligned with and receiving said upper protrusions.

14. A package as claimed in claim 13 wherein:

said predetermined dimensions comprise said upper protrusions extending from said upper edge of said support panel a distance substantially equal to the depth of said recesses from said lower edge of said support panel plus the thickness of the package material disposed between said adjacent engaged support panels.

15. A package as claimed in claim 14 wherein:

said support panels comprise wood material.

16. A package as claimed in claim 9 wherein:

a space is provided between each end wall and the adjacent support panel over at least a part of the length of said end wall; and tabs are provided on said lid for positioning in said space.

17. A package made of package material in the form of a tray, carton or case comprising:

a base having opposite sides and opposite ends;

side walls extending from said sides;

end walls extending from said ends;

corners formed by said side walls and end walls;

apertures in said package adjacent said end walls;

a pair of support panels disposed within the package adjacent said end walls;

protrusions on said support panels extending through at least some of said apertures and having predetermined dimensions with respect to the thickness of the package material so that when said package is substantially vertically stacked with a plurality of said packages, with said protrusions extending through said apertures, said protrusions of one package engage corresponding adjacent support panels of adjacent packages in the stack to thereby prevent substantial compression of package material disposed between said engaged adjacent support panels;

angled lugs at each corner extending outwardly from the package in a direction opposite to said base; and cut-out sections at said corners adjacent said base having a configuration so that when stacked said lugs of one package engage said cut-out sections of an adjacent package for retaining said packages in the stacked position.

18. A package as claimed in claim 17 wherein:

said apertures comprise lower apertures in said base;

each support panel has an upper edge; and said protrusions comprise upper protrusions extending from said upper edges.

19. A package as claimed in claim 18 wherein:

each support panel has a lower edge;

said protrusions further comprise lower protrusions extending from said lower edges; and said lower apertures are aligned with and receive therein said lower protrusions so that when a plurality of said packages are stacked said upper protrusions of one support panel engage with said lower protrusions of the adjacent corresponding support panel.

20. A package as claimed in claim 19 wherein:

each end wall has a flap portion extending over at least said upper edge of the adjacent support panel;

said apertures further comprise upper apertures in said flap portions aligned with and receiving said upper protrusions; and said predetermined dimensions comprise said protrusions extending from said edges a distance substantially equal to the thickness of the package material.

* * * * *

UNITED STATES PATENT AND TRADEMARK OFFICE

CERTIFICATE OF CORRECTION

PATENT NO. : 4,911,356

DATED : March 27, 1990

INVENTOR(S) : Townsend, et al.

It is certified that error appears in the above-identified patent and that said Letters Patent is hereby corrected as shown below:

On the title page, item [76], last line, delete "Netherlands" and insert --New Zealand--.

Signed and Sealed this

Fifteenth Day of October, 1991

*Attest:*

HARRY F. MANBECK, JR.

*Attesting Officer*

*Commissioner of Patents and Trademarks*